United States Patent [19]

Murray

[11] Patent Number: 4,488,726

[45] Date of Patent: Dec. 18, 1984

[54] SPORTS TRAINING GLOVE INCLUDING PRESSURE ACTUATED SWITCHES FOR ALARM CIRCUIT

[76] Inventor: William F. Murray, Carrig House, Roundwood, County Wicklow, Ireland

[21] Appl. No.: 491,174

[22] Filed: May 3, 1983

[30] Foreign Application Priority Data

May 7, 1982 [IE] Ireland ..... 1105/82

[51] Int. Cl.[3] ..... A63B 69/36

[52] U.S. Cl. ..... 273/183 B; 2/161 A; 116/DIG. 44

[58] Field of Search ..... 2/160, 161 R, 161 A; 273/183 B; 434/229; 116/DIG. 44

[56] References Cited

U.S. PATENT DOCUMENTS 2,311,276 2/1943 Wilcox ..... 2/160 X
3,670,574 6/1972 Edwards ..... 2/160 X
4,055,905 11/1977 Budrose ..... 434/229

FOREIGN PATENT DOCUMENTS 1587191 4/1981 United Kingdom ..... 273/183 B

*Primary Examiner*—George J. Marlo
*Attorney, Agent, or Firm*—Birch, Stewart, Kolasch & Birch

[57] ABSTRACT

The sports practice glove is for use with a club, racket, bat or other item of sports equipment which has a handle to be gripped. The glove has a pressure operated switch on each finger and on the thumb of the glove and on the palm area of the glove. The switches which are rubber pad pressure operated switches of the normally closed kind are connected to a battery operated alarm circuit having an audible alarm. When in use and the glove is worn and a club properly gripped the switches are all held open. However if the club is improperly gripped the pressure on one or more switches will fall below a predetermined threshold a switch or switches will close and the alarm is actuated.

8 Claims, 1 Drawing Figure

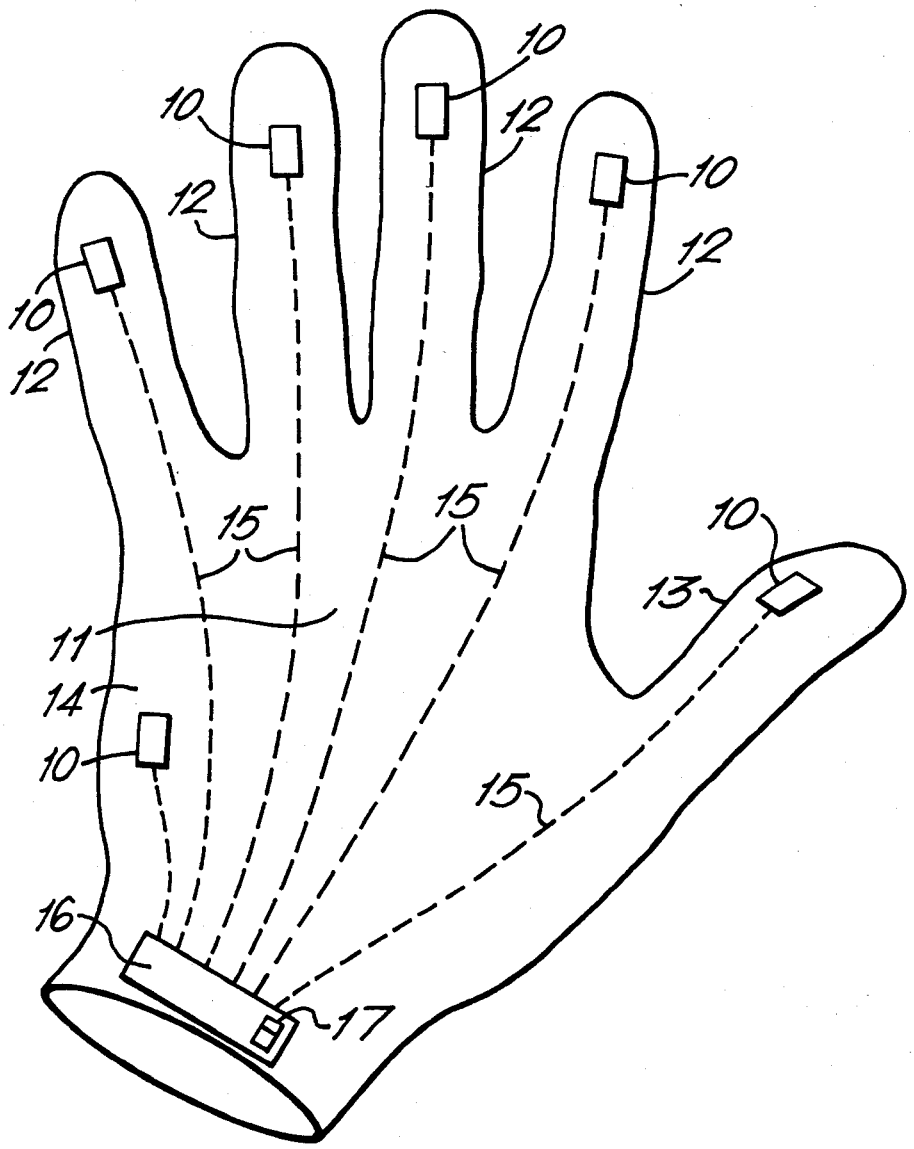
10
10
12
10
12
12
10
12
15
15
10
13
11
14
10
15
16
17

SPORTS TRAINING GLOVE INCLUDING PRESSURE ACTUATED SWITCHES FOR ALARM CIRCUIT

BACKGROUND AND OBJECTS OF THE INVENTION

This invention relates to a sports practice glove for use with a club, racket, bat or other item of sports equipment having a handle to be gripped.

It is well known that, in golf and tennis in particular, good results are achieved by maintaining a firm grip on the handle of the racket or club before, during and after a shot or stroke is made. The object of the present invention is therefore to provide a construction of sports glove for practice use which will automatically indicate to the user by an audible alarm if the grip on the handle slackens while making a shot or stroke.

Accordingly, the invention provides a sports practice glove for use with a club, racket, bat or other item of sports equipment having a handle to be gripped, the glove comprising a plurality of independently operable pressure-operated switches arranged on its inside gripping surface and an alarm circuit coupled to the switches in such manner that the alarm is actuated when the pressure on any one or more of the switches is reduced below the switching threshold pressure of the switch, the switches being disposed at locations on the glove which will bear against the handle of the sports equipment when the latter is properly gripped. Preferably the alarm is an audible alarm.

Naturally the number and exact disposition of the switches on the inside gripping surface of the glove will vary both with the glove size and the particular item of sports equipment for which the glove is designed. However, most applications will involve at least one switch on the inside of each finger and thumb of the glove, and at least one switch one the palm area.

The alarm circuit preferably includes an on-off switch to disable the alarm when the glove is not being worn or when it is not desired to monitor the grip on the handle while playing.

BRIEF DESCRIPTION OF THE DRAWING

An embodiment of the invention will now be described, by way of example, with reference to the accompanying drawing which shows a golf practice glove viewed in the direction of its inside gripping surface.

DETAILED DESCRIPTION OF THE INVENTION

The practice golf glove has a plurality of rubber pad pressure-operated switches 10 secured to the inside gripping surface 11 of the glove, one switch near the tip of each finger 12 and thumb 13, and one on the outside palm area 14. The rubber pad switches 10 may be similar to those used in small pocket calculators such as the Sharp Elsimate Model EL-821, except that the switches 10 are for preference of a normally-closed kind as hereinafter described. The location of the switches 10 is chosen such that when a golf club handle is properly gripped all the switches will bear against the handle of the club. The switches 10 may be exposed on the surface 11, or, where the glove is of multilayer fabric construction, located beneath the outer layer of the surface 11.

The switches 10 are connected by hidden wires 15 to a miniaturized alarm circuit 16 having a buzzer (not shown) and an on-off switch 17, the alarm circuit being battery operated from miniature batteries also not shown. Miniaturized battery-operated alarm circuits of a kind suitable for use in the present invention are well known in, for example, digital wristwatches. The alarm circuit 16 including the buzzer and batteries is preferably incorporated in the wrist of the glove as shown, but it may alternatively be carried separately and connected to the glove by suitable wires.

The switches 10 are preferably of a normally-closed kind and are connected in parallel across the battery and buzzer the latter being arranged in series. In such case, when the glove is worn and a golf club is properly gripped all the switches 10 are held open by the pressure of the grip so that a circuit across the buzzer is not completed via any switch. If, however, the grip is relaxed to an extent that the pressure on any one or more switches 10 is reduced below the threshold pressure required to operate the switch 10, the switch 10 will resume its normally-closed condition thereby completing a circuit across the buzzer and sounding an alarm.

Clearly the invention is not restricted to the specific circuit described above; for example, normally-open switches arranged in series may be used with the alarm circuit designed to sound an alarm when any one of the switches, which are all held closed by the pressure of the grip, is allowed to open of the grip whereby the continuity of the circuit through the series of switches is broken.

I claim:

1. A sports practice glove for use with a club, racket, bat or other item of sports equipment having a handle to be gripped, the glove comprising:

a plurality of independently operable pressure-operated switches operable in response to a predetermined switching threshold pressure being arranged on an inside gripping surface of said glove; and an alarm circuit coupled to the switches in such manner that the alarm is actuated when the pressure on any one or more of the switches is reduced below the switching threshold pressure of the switch, the switches being disposed at locations on the glove which will bear against the handle of the sports equipment when the latter is properly gripped.

2. A glove as claimed in claim 1 in which the alarm circuit is coupled to the switches in such manner that an audible alarm is sounded when the pressure on any one or more of the switches is reduced below a threshold determined by the switch pressure.

3. A glove as claimed in claim 2 in which each of the switches is connected to a battery operated miniaturized alarm circuit having an audible alarm.

4. A glove as claimed in claim 3 in which the battery and the audible alarm are incorporated in the wrist of the glove.

5. A glove as claimed in claim 3 in which the switches are of a normally closed kind and are connected in parallel across the battery and the audible alarm, the battery and audible alarm being connected to each other in series, whereby in use when the glove is worn and a club properly gripped all the switches are held open by the pressure of the grip and further when the club is improperly gripped the pressure on one or more switches is reduced below a threshold pressure required to maintain each switch open thereby allowing closure of the switch or switches to complete the circuit and actuate the audible alarm.

6. A glove as claimed in claim 1 in which on each finger and on the thumb of the glove there is provided at least one switch.

7. A glove as claimed in claim 1 in which a switch is secured on each finger and on the thumb of the glove and on the outside palm area of the glove.

8. A glove as claimed in claim 1 in which the switches are rubber pad pressure-operated switches.

* * * * *